United States Patent [19]

Robert

[11] 3,939,876

[45] Feb. 24, 1976

[54] WEFT-BEATING MECHANISM WITH VARIABLE-STROKE REED

[75] Inventor: Jean Robert, Bourgoin, France

[73] Assignee: Saurer Diederichs (Société Anonyme), Bourgoin, France

[22] Filed: Apr. 12, 1974

[21] Appl. No.: 460,575

[30] Foreign Application Priority Data

Apr. 19, 1973 France ..... 73.15061

[52] U.S. Cl. ..... 139/26

[51] Int. Cl.[2] ..... D03D 39/22

[58] Field of Search ..... 139/25, 26, 27, 188, 190, 139/191

[56] References Cited

UNITED STATES PATENTS

| | | | |
|---|---|---|---|
| 501,585 | 7/1893 | Young | 139/26 |
| 1,593,851 | 7/1926 | Ryon | 139/26 |
| 3,339,589 | 9/1967 | Gotz et al. | 139/26 |

*Primary Examiner*—Henry S. Jaudon
*Attorney, Agent, or Firm*—Karl F. Ross; Herbert Dubno

[57] ABSTRACT

A weft-beating mechanism with variable-stroke reed for use in a loom for weaving toweling fabric in which, between the sley and the drive, there is provided a transmission operable by a control element to vary the stroke of the sley. The transmission comprises a sleeve having a multiplicity of axial grooves juxtaposed with axial grooves on the control element, the confronting grooves receiving balls for coupling the control element with the sleeve. The control element is provided additionally with helical grooves which confront helical grooves on the sley, the confronting grooves receiving balls for coupling the sley to the control element. When axial displacement of the control element is prevented, therefore, the sley undergoes full stroke displacement whereas, when the control element permits axial displacement, a less than full stroke is applied.

4 Claims, 6 Drawing Figures

WEFT-BEATING MECHANISM WITH VARIABLE-STROKE REED

The invention relates to apparatus for beating up the weft or pick, which can be applied to a weaving loom for the production of a towelling fabric, wherein a complete beating movement in each case follows a plurality of partial beating movements by the reed by the shortening the stroke of the loom sley.

According to the invention there is provided a mechanism for use in a loom for weaving towelling fabric and in which the sley has a stroke having an unvarying rear position and in which a complete beating stroke of the sley follows a plurality of partial beating operations produced by reduction of the stroke of the sley. The mechanism comprises a respective transmission unit located between each end of the sley and a driving mechanism with a constant stroke of operation. The transmission units each comprise at least one input member driven by said driving mechanism and a driven member connected with the sley. The input member and the driven member are provided with a series of pairs of opposed grooves and are connected by sets of corresponding sliding or rolling members, one of these pairs of grooves being parallel to the axis of the transmission unit and at least one of the other pairs of grooves having a helical profile. A shaft parallel to the sley serves to connect a control member for one transmission unit to a control member for the other transmission unit so that change in angular position of the shaft gives either a complete or a partial stroke for the sley.

According to a first embodiment, each of the transmission units comprises a drive member, a driven member and a control member disposed concentrically and in connection with each other by means of two pairs of gooves, the pair located between the drive member and the control member being parallel to the axis, while the pair located between the control member and the driven member is helical and has a fairly long pitch.

According to this first embodiment, each of the control members is equipped with its own shaft, which is held in alignment with the shaft of the other member, each of these two half shafts being equipped with a finger or roller, capable of turning in a ramp, in which a flat part follows a helical part, these two ramps being integral with each other and capable of simultaneous displacement by means of an angular movement, which compels the aforementioned fingers or rollers to follow the profile of this movement, thus effecting axial displacement of the two half shafts.

According to a second embodiment, an intermediate member is interposed between the drive member and the driven member, the transmission of the movement being effected through this intermediate member to the control member by a third pair of grooves having a helical profile and a short pitch.

According to this second embodiment, the two control members are rigidly connected to each other by a common shaft, for which change of the angular position is obtained by a lever emerging through an elongated hole provided in the loom sley and yoked to a connecting arm and lever system, in which the position of the fixed point can be varied.

Two specific embodiments of the invention will now be described by way of example with reference to the accompanying drawing, in which.

Figure 1:
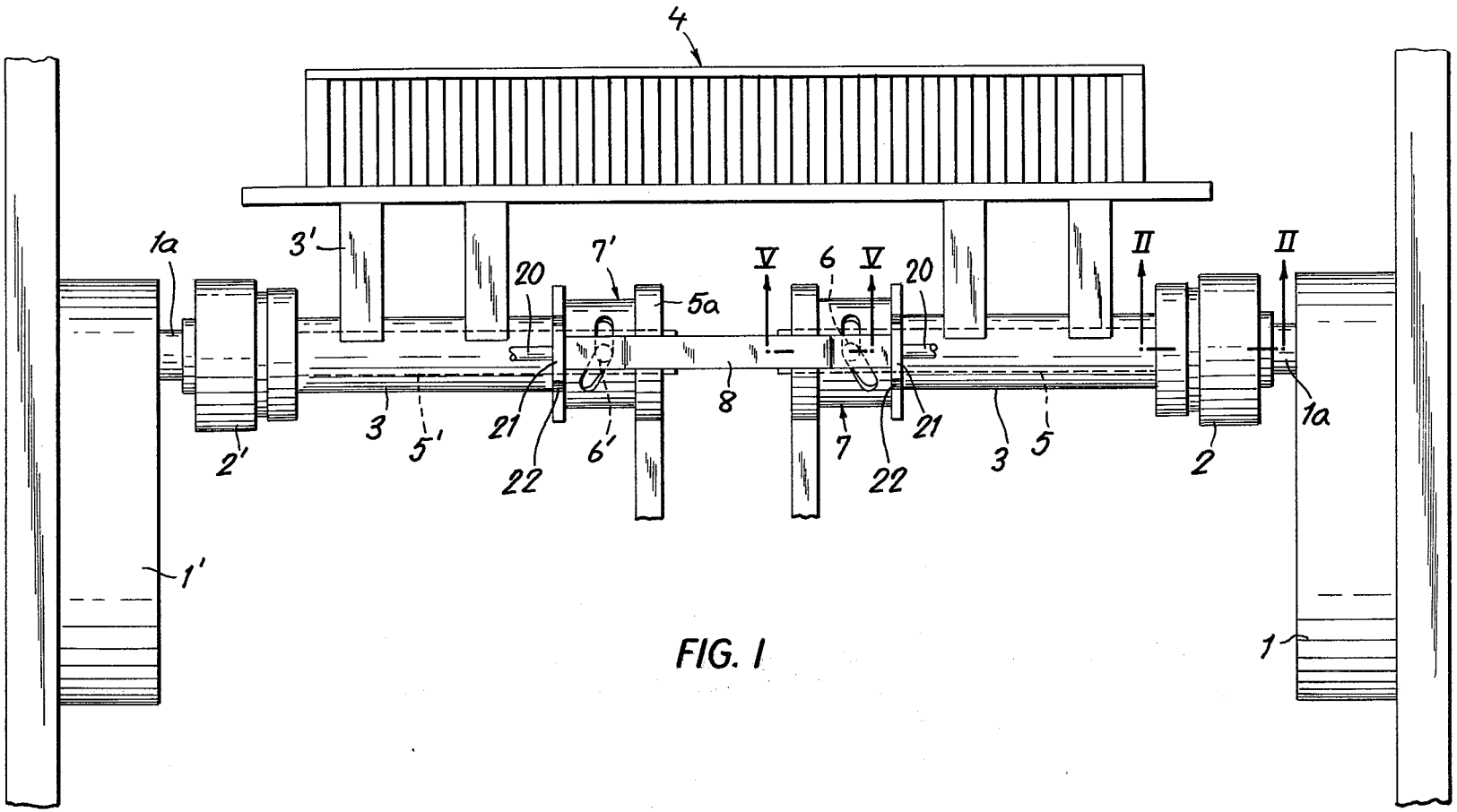
FIG. 1 is a diagrammatic overall view, in elevation, as seen from the front of the loom, of a mechanism for beating the pick.

In the drawing, I show the housing 1, 1' of two mechanisms with coupled cams 1 and 1' are of a known type for oscillating the shafts 1*a*.

Figure 2:
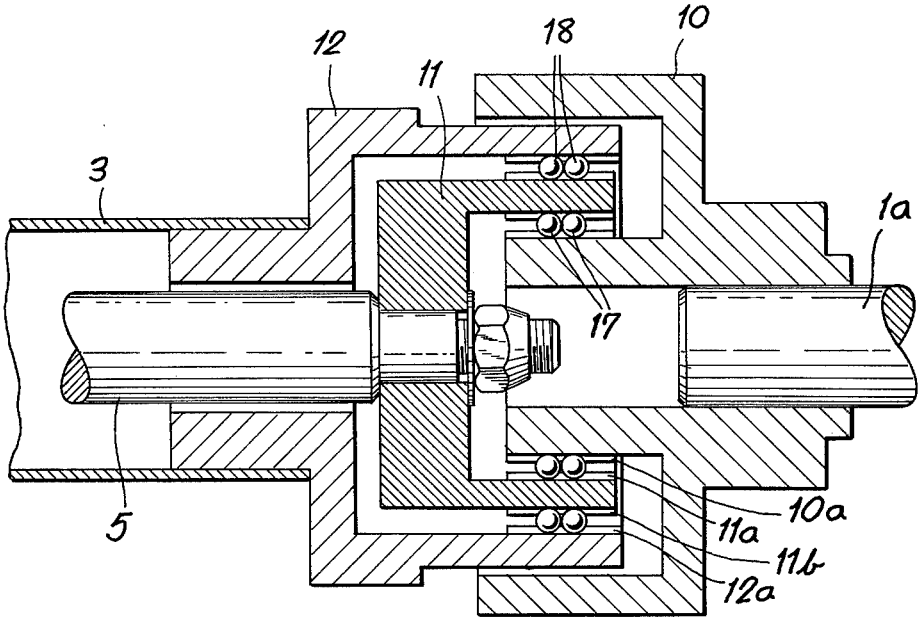
FIG. 2 shows an axial section, taken along line II—II in FIG. 1, of a detail of one of the transmission units.

These mechanisms actuate a one-piece sley carried by tubes or hollow shafts 3, which via supports 3' carrying a reed 4, by the agency of two transmission units 2 and 2', which are identical to each other and a detail of which is shown in FIG. 2. The sley is not directly connected to the two mechanisms 2, 2', which have a constant angular stroke and impart movement to the sley and are at opposite ends thereof.

Figure 5:
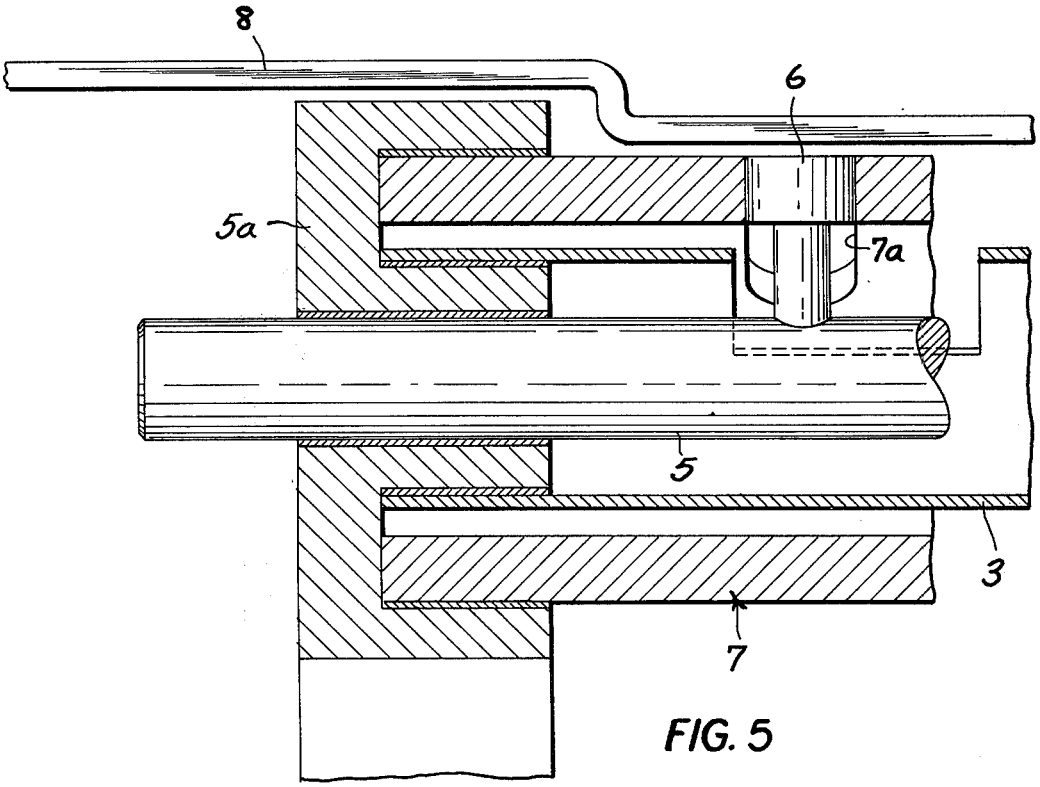
FIG. 5 is a section taken along line V—V of FIG. 1 of the mounting of the end of the shaft.

Each of these units 2, 2' is connected to a respective shaft 5, 5' supported, for example, at 5*a* (FIG. 5), carrying rollers 6, 6', which pass through the tubes 3 of the sley 3 and are guided in ramps of drums 7, 7' integral with or connected to each other by a member 8. The drums 7, 7' and shaft 5 or *f'* are also supported by the respective bearing 5*a*.

Figure 6:
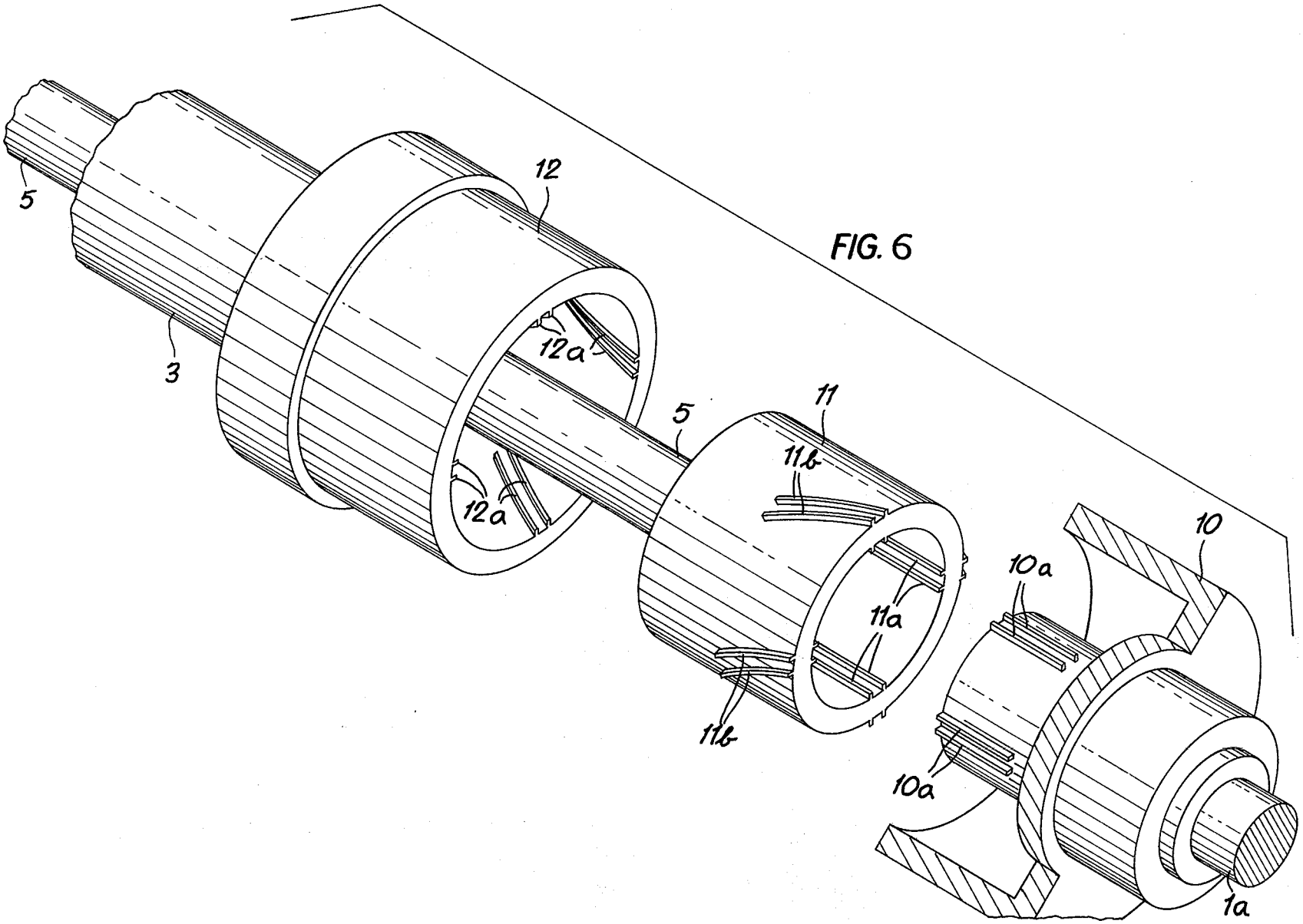
FIG. 6 is a perspective view in exploded for of the mechanism of FIG. 2.

Each of these transmission units 2 or 2' comprises (see FIGS. 2 and 6): a drive member 10, clamped on an output shaft 1*a* of the corresponding mechanism 1 and carrying grooves 10*a* on its external periphery, a control member 11, disposed concentrically relative to the aforementioned member 10 and comprising grooves 11*a* on its internal periphery opposite the grooves 10*a;* this control member further comprises another series of grooves 11*b* on its external periphery and is integral with the corresponding shaft 5, and a receiver or driven member 12, integral with the sley 3, which is in turn disposed concentrically relative to the control member 11 and comprises grooves 12*a* on its internal periphery opposite the grooves 11*b*.

The pairs of grooves 10*a* and 11*a* are disposed parallel to the axis and are connected to each other by bearings or balls 17.

As regards the pairs of grooves 11*b* and 12*a*, these are also connected to each other by bearings or balls 18, but they have the characteristic feature of being helical and of having a fairly long pitch.

Owing to the member 10, the member 11 thus receives the entire oscillatory movement imparted by the mechanism 1 with coupled cams, but its movement remains free and is compulsorily accompanied in relation to the member 12, by rotation of one of these members relative to the other.

Figure 3:
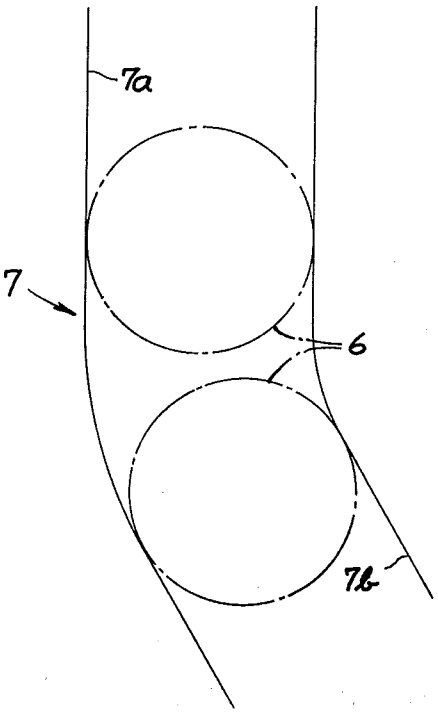
FIG. 3 shows a developed view of one of the guide ramps shown in FIG. 1.

The guide ramps of drum 7, one of which is shown in FIG. 3, each comprise a straight transverse section 7*a* which prevents axial displacement of the roller 6 during the oscillatory movement of the sley and a helical section 7*b* permitting axial displacement of the roller 6. These two sections 7*a* and 7*b* are connected to each other by a curve having a shape suitable for the prevention of shocks when the roller passes from one section to the other.

It follows that, when the control mechanism brings the section 7*a* of the ramp into the position opposite the path of the roller 6, the member 11 does not undergo any axial displacement; the sley carries out a complete stroke.

On the other hand, when the control mechanism brings the helical section 7*b* into the path of the roller 6, the member 11 can undergo an axial displacement by the agency of the shaft 5. The member 11 thereby slides on the members 10 and 12, and the member 12 is pivoted relative to the member 11 and therefore also relative to the member 10; the sley carries out an incomplete stroke.

If the roller 6 encounters the helical ramp 7*b* immediately on commencing its displacement, the sley carries out the shortest possible stroke. However if the roller starts on the section 7*a* of the ramp so as to later encounter the helical section 7*b*, the stroke or beat of the sley will be incomplete, but longer than previously. Thus a pre-determined beat stroke of the sley corresponds to each position of the ramps and it can be seen that any intermediate stroke can be attained, that is, any desired height of the loop can be obtained simply by changing the position occupied by the ramps during the incomplete strokes.

Figure 4:
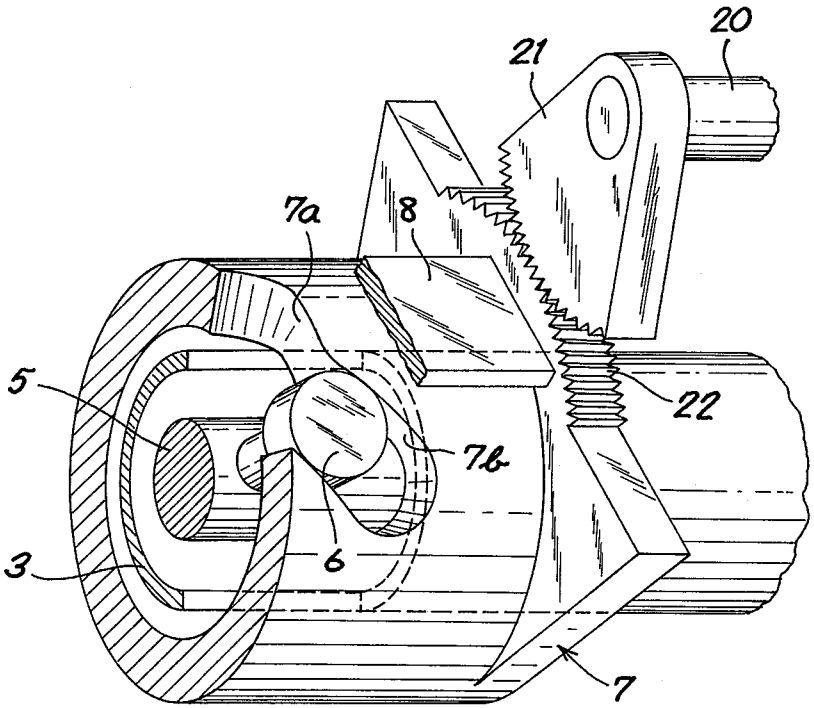
FIG. 4 is a perspective view, partly broken away, of the control device for these guide ramps.

According to the method of control for the ramps of drums 7, 7′ illustrated in FIG. 4, a shaft 20 is controlled by a cam mechanism of a known type, capable of being disengaged as desired, but only in the position for the complete stroke. This mechanism has a sector 21 which meshes with an opposed sector 22, secured on the same support 8 as the ramps 7 and 7′. The angular position of the shaft 20 also determines the position of the ramps. The connection by means of gear teeth was selected as giving the greatest degree of longitudinal freedom to the ramps, but connection by means of rods can also be envisaged.

When the shaft 20 occupies the position shown in FIG. 4, the ramps are in the lower position; the rollers 6 roll on the transverse sections 7*a* and the members 11 do not undergo movement, the stroke is complete.

On the other hand, when the shaft 20 and the section 21 occupy the position shown by broken lines, the rollers 6 roll on helical section 7*a* and permit movement to the members 11, thus producing rotation of the member 12 relative to the members 10, and the orientation of the grooves on the members 11 is such that the stroke is shorter than previously.

The shape of the ramps 7 is such that, when the sley is in the rear position, the roller 6 is always on the flat section of the ramp, even if this member is positioned so as to produce an incomplete stroke. In this manner, the rear position of the sley is retained without there being any need for operation of the control.

Because the straight grooves 10*a*, 11*a* disposed on the members 10 of the unit 2, on one side, and on corresponding members of the unit 2′ on the other, the mechanisms with coupled cams 1,1′ do not receive any particular axial thrust.

Because the helical grooves 11*b* and 12*a*, which are disposed in opposite senses in the units 2 and 2′, axial thrust on the members 11 and 12 is counterbalanced through the agency of the sley 3, without action on any of the bearings. Axial thrust on the members 11 is also counterbalanced through the agency of the shafts 5 and 5′ the rollers 6 and 6′, the ramps 7 and 7′, and their common support 8, which is capable of longitudinal movement.

The support 8 retains a certain degree of longitudinal freedom, and thus slight angular displacement of one control mechanism 1, 1′ relative to the other produces longitudinal displacement of the unit formed by the members 5,5′; 6,6′; 7, 7′; 8. Counterbalancing of the effects of slight faults in mounting is an important factor for the longevity of a mechanism under such stress.

It should be noted that the shape of the ramps 7,7′ is such that the sley occupies a single rearward position whatever may be the required stroke of the reed.

It should also be noted that this mounting hand permits several different strokes to be programmed for the purpose of obtaining loops of different heights in one fabric and, on the other hand, adjustment is obtained by acting on a single member.

What we claim is:

1. In a loom for weaving toweling fabric having a reed carried by a sley for beating up the weft and a sley drive having an output shaft for displacing said sley, the improvement which comprises a transmission between said shaft and said sley for varying the stroke of said reed, said transmission including a first cylindrical member connected to said drive, a second cylindrical member coaxial with said first member and connected to said sley, a cylindrical control element coaxial with and interposed between said members, said first member and said element being formed with a first set of confronting grooves and respective bridging elements received in the confronting grooves and mobile therein, said control element and said second member being formed with a second set of mutually confronting grooves and respective bridging elements received in and mobile in the confronting grooves of said second set, the grooves of one of said sets being rectilinear parallel to the axis of said members and said control element and the grooves of the other set lying on a helix centered on said axis; and means for selectively regulating the axial displacement of said control element to vary the stroke of said sley.

2. The improvement defined in claim 1 wherein said sley drive comprises a pair of drive units disposed at opposite ends of said sley, each of said units having an output shaft, a respective such transmission being provided between each of said shafts and the respective end of the sley, said control elements of said transmissions being interconnected for joint displacement.

3. The improvement defined in claim 2 wherein said means for selectively regulating the axial displacement of said control elements includes a respective roller mounted on each of said control elements, a respective guide formed with a slot receiving the respective roller, said slots each having a circumferential portion and a helical portion interconnected with the respective circumferential portion, and means coupling said guides for joint angular displacement about said axis.

4. The improvement defined in claim 3 wherein said means coupling said guides for joint angular displacement about said axis includes a gear sector, said means for selectively regulating the axial displacement of said control element including a second gear sector meshing with the first gear sector.

* * * * *